US007248827B2

(12) United States Patent
Cho et al.

(10) Patent No.: US 7,248,827 B2
(45) Date of Patent: Jul. 24, 2007

(54) FUSING ROLLER DEVICE FOR ELECTROPHOTOGRAPHIC IMAGE FORMING APPARATUS

(75) Inventors: Durk-hyun Cho, Gyeonggi-do (KR); Hwan-guem Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/226,298

(22) Filed: Sep. 15, 2005

(65) Prior Publication Data

US 2006/0008303 A1 Jan. 12, 2006

Related U.S. Application Data

(63) Continuation of application No. 10/655,398, filed on Sep. 5, 2003, now Pat. No. 6,990,310.

(30) Foreign Application Priority Data

Nov. 11, 2002 (KR) ..... 2002-69591

(51) Int. Cl.
*G03G 15/20* (2006.01)

(52) U.S. Cl. ..... 399/330; 219/216

(58) Field of Classification Search ..... 399/88, 399/90, 320, 330, 335; 219/216, 388, 469, 219/471, 541; 492/46

See application file for complete search history.

(56) References Cited

U.S. PATENT DOCUMENTS

| | | | |
|---|---|---|---|
| 5,308,515 | A | 5/1994 | Michlin et al. |
| 6,091,059 | A | 7/2000 | Sato et al. |
| 6,122,479 | A | 9/2000 | Fujita et al. |
| 6,252,199 | B1 | 6/2001 | Toyota et al. |
| 6,455,824 | B2 | 9/2002 | Takagi |
| 6,571,080 | B2 | 5/2003 | Lee et al. |
| 6,690,907 | B2 * | 2/2004 | Lee ..... 399/330 |

FOREIGN PATENT DOCUMENTS

| | | | |
|---|---|---|---|
| CN | 2238405 | | 10/1996 |
| CN | 2281556 | | 5/1998 |
| CN | 1360232 | | 7/2002 |
| EP | 240730 | A1 | 3/1987 |
| EP | 0241714 | A1 | 12/1987 |
| EP | 1128231 | A2 | 8/2001 |
| EP | 1217466 | A1 | 6/2002 |
| EP | 1288735 | A1 | 3/2003 |
| JP | 62-247386 | | 10/1987 |
| JP | 4-335691 | | 11/1992 |
| JP | 4-360185 | | 12/1992 |
| JP | 06-250551 | | 9/1994 |
| JP | 8-171301 | | 7/1996 |
| JP | 08-202192 | | 8/1996 |
| JP | 8-262905 | | 10/1996 |
| JP | 8-305195 | | 11/1996 |
| JP | 08-328416 | | 12/1996 |
| JP | 9-90811 | | 4/1997 |
| JP | 11-282294 | | 10/1999 |
| JP | 2000-158580 | | 6/2000 |
| JP | 2001-76845 | | 3/2001 |
| JP | 2002-169398 | | 6/2002 |
| JP | 2002-251101 | | 9/2002 |
| WO | 03/102698 | A1 | 12/2003 |

OTHER PUBLICATIONS

Korean Office Action for Application No. 10-2002-0069591dated Aug. 31, 2004.
Chinese Office Action relative to Chinese Application No. 200310103665.7.

* cited by examiner

*Primary Examiner*—Hoan Tran
(74) *Attorney, Agent, or Firm*—Staas & Halsey LLP

(57) ABSTRACT

A fusing roller device for an electrophotographic image forming apparatus, the device including an internal tube having both ends open; a heating portion surrounding the internal tube and generating heat by externally supplied current; and a fusing roller surrounding the heating portion and fusing a toner image on paper by heat transferred from the heating portion.

23 Claims, 5 Drawing Sheets

FUSING ROLLER DEVICE FOR ELECTROPHOTOGRAPHIC IMAGE FORMING APPARATUS

CROSS-REFERENCE TO RELATED APPLICATIONS

This application is a Continuation of application Ser. No. 10/655,398, filed Sep. 5, 2003, now U.S. Pat. No. 6,990,310, which claims priority from Korean Patent Application No. 2002-69591, filed on Nov. 11, 2002, in the Korean Intellectual Property Office, the disclosures of which are incorporated herein their entirety by reference.

BACKGROUND OF THE INVENTION

1. Field of the Invention

The present invention relates to a fusing roller device for an electrophotographic image forming apparatus, and, more particularly, to a fusing roller device for an electrophotographic image forming apparatus that can be instantaneously heated so that the temperature of the fusing roller device reaches a fusing temperature within a relatively short time, while using a low amount of current and power.

2. Description of the Related Art

In general, a printer, such as a laser printer, includes a fusing roller device that fixes toner particles transferred on a printing medium. FIG. 1 is a profile cross-sectional view schematically illustrating a conventional fusing roller device for an electrophotographic printer in which a halogen lamp is used as a heat source, and FIG. 2 is a vertical cross-sectional view illustrating a correlation between the conventional fusing roller device and a pressure roller for an electrophotographic printer in which the halogen lamp shown in FIG. 1 is used as a heat source.

Referring to FIG. 1, a conventional fusing roller device 10 includes a tubular fusing roller 11 and a heating portion 12, such as a halogen lamp, that is installed along a center axis of the fusing roller 11. A coating layer 11*a* of TEFLON® is formed on the surface of the fusing roller 11. The fusing roller 11 is heated by radiant heat transmitted from the heating portion 12.

Referring to FIG. 2, a pressure roller 13 is placed opposite and under the fusing roller device 10. Paper 14 is placed between the fusing roller device 10 and the pressure roller 13. The pressure roller 13 is elastically supported by a spring 13*a*, and presses the paper 14 passing between the fusing roller device 10 and the pressure roller 13 toward the fusing roller device 10 by a predetermined pressure. A toner image 14*a* in a powder state formed on the paper 14 is pressed and heated while the paper 14 passes between the fusing roller device 10 and the pressure roller 13. That is, the toner image 14*a* is fused on the paper 14 as a result of the heat generated by the fusing roller device 10 and the pressure applied by the pressure roller 13.

The conventional fusing roller device, in which a halogen lamp is used as a heating portion 12, as described above causes unnecessary power consumption. Thus, when a printing operation is not being performed, the fusing roller device 10 needs to be cooled by turning off the power. In particular, when the fusing roller device 10 is turned off and then turned on to form an image, a relatively long warm-up time is required. After power is applied to the fusing roller device 10, the fusing roller device 10 remains in a waiting state for a predetermined amount of time (i.e., a first-print-out-time referred to hereinafter as FPOT) until it reaches a desired fusing temperature. This might take from several tens of seconds to several minutes.

In particular, because the fusing roller 11 is heated by heat radiated from the heat source, the conventional fusing roller device 10 has a slow heat transfer speed, and because compensation for a decrease in temperature that occurs due to contact with the paper 14 is slow, the conventional fusing roller device 10 cannot easily adjust temperature scatter. In addition, even in a standby mode in which a printing operation is paused, power must be applied to the heating portion 12 at predetermined time intervals so that the temperature of the fusing roller 11 is maintained at a constant level. Thus, unnecessary power consumption occurs. Because it takes a relatively long time to change from a standby state to an operation mode to output an image, the conventional fusing roller device 10 cannot quickly output an image.

FIG. 3 is a vertical cross-sectional view schematically illustrating another conventional fusing roller device for an electrophotographic image forming apparatus. Referring to FIG. 3, a heating plate 22 is provided in a lower portion of the inside of a cylindrical film tube 21, and a pressure roller 23 is installed opposite to a lower side of the heating plate 22. Paper 14 is placed between the film tube 21 and the pressure roller 23. The pressure roller 23 is elastically supported by a spring 23*a* such that the paper 14 passing between the film tube 21 and the pressure roller 23 is pressed by a predetermined pressure toward the film tube 21.

The film tube 21 is rotated by an additional rotating device (not shown). A method for locally film the heating tube 21 in a portion where the heating plate 22 contacts the pressure roller 23 has low power consumption, but the method cannot be easily used during a high-speed printing operation.

To solve the problems described above, Japanese Patent Publication No. Hei 11-282294 discloses a heat induction method by which heat is transferred directly to the surface of a fusing roller by providing high-frequency AC from an electrical coil installed around a non-image region, that is, a portion in which toner of the fusing roller does not contact paper. In this method, heat generated from the non-image region flows through the surface of an image region of the fusing roller, and the FPOT is reduced. However, the fusing roller requires an additional circuit to produce high-frequency current, and, as such, the roller mechanism is complicated, which increases costs.

In addition, fusing roller devices disclosed in Japanese Patent Publication Nos. Hei 4-335691, Hei 4-360185, Hei 8-171301, Hei 8-262905, Hei 8-305195, and Hei 9-90811 have structures in which a heat source is provided inside a fusing roller and an overall increase in the size of the heat source is not considered. Also, since a plurality of local heat pipes are provided in the fusing roller, processing and manufacturing thereof are very complicated, and a temperature difference occurs between a portion contacting the heat pipes and a portion not contacting the heat pipes.

SUMMARY OF THE INVENTION

It is an aspect of the present invention to provide a fusing roller device for an electrophotographic image forming apparatus in which the temperature of the fusing roller can be increased to a fusing temperature within a short time, while using low current and low power.

Additional aspects and/or advantages of the invention will be set forth in part in the description that follows and, in part, will be obvious from the description, or may be learned by practice of the invention.

To achieve the above and/or other aspects of the present invention, there is provided a fusing roller device for an electrophotographic image forming apparatus, the device comprising: an internal tube having both ends open; a heating portion surrounding the internal tube and generating heat by externally supplied current; and a fusing roller surrounding the heating portion and fusing a toner image on paper by heat transferred from the heating portion.

To achieve the above and/or other aspects according to the present invention, there is provided a method of manufacturing a fusing roller device for an electrophotographic image forming apparatus, the fusing roller device having an internal tube, a heating portion, a fusing roller to fuse a toner image on paper by heat transferred from the heating portion, a first insulator, and a second insulator, the method including surrounding the internal tube with the first insulator; surrounding the first insulator with the heating portion; surrounding the heating portion with the second insulator; inserting the internal tube in the fusing roller; extending the internal tube by closing both ends of the internal tube, applying a predetermined pressure to the interior of the internal tube, the fusing roller being maintained in a circular shape and the heating portion and the insulator being plastically deformed to closely adhere the heating portion, the internal tube, the first insulator, and the second insulator to one another and to closely adhere the heating portion to an inner surface of the fusing roller.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and/or other aspects and advantages of the invention will become apparent and more readily appreciated from the following description of the preferred embodiments, taken in conjunction with the accompanying drawings, of which.

DETAILED DESCRIPTION OF THE INVENTION

Figure 1:
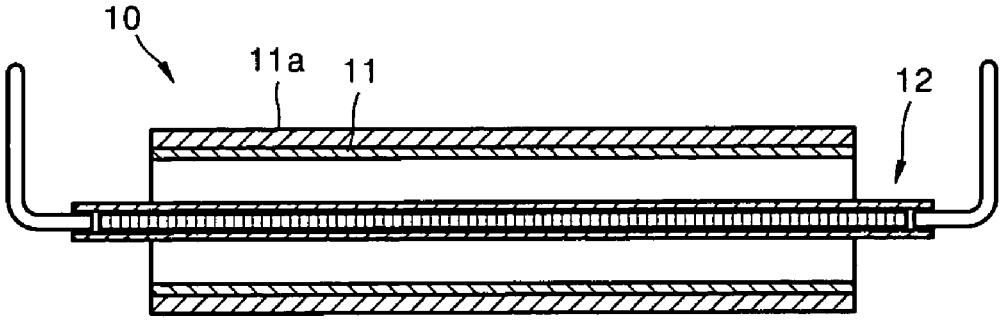
FIG. 1 (PRIOR ART)
FIG. 1 is a profile cross-sectional view schematically illustrating a conventional fusing roller device for an electrophotographic printer, in which a halogen lamp is used as a heat source.
Figure 2:
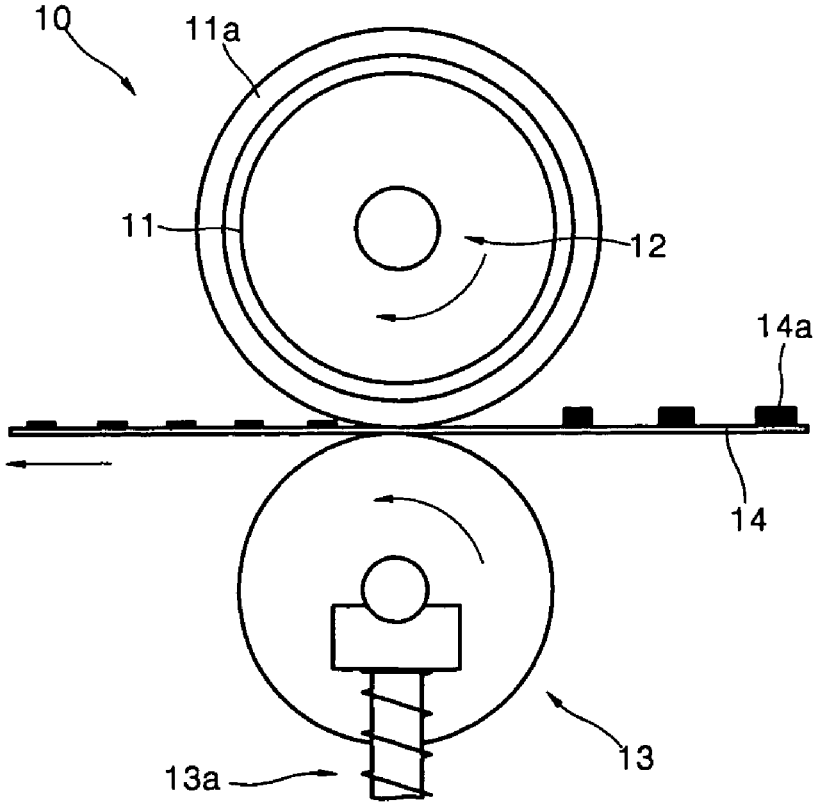
FIG. 2 (PRIOR ART)
FIG. 2 is a vertical cross-sectional view illustrating a correlation between the conventional fusing roller device of FIG. 1 and a pressure roller for an electrophotographic printer.
Figure 3:
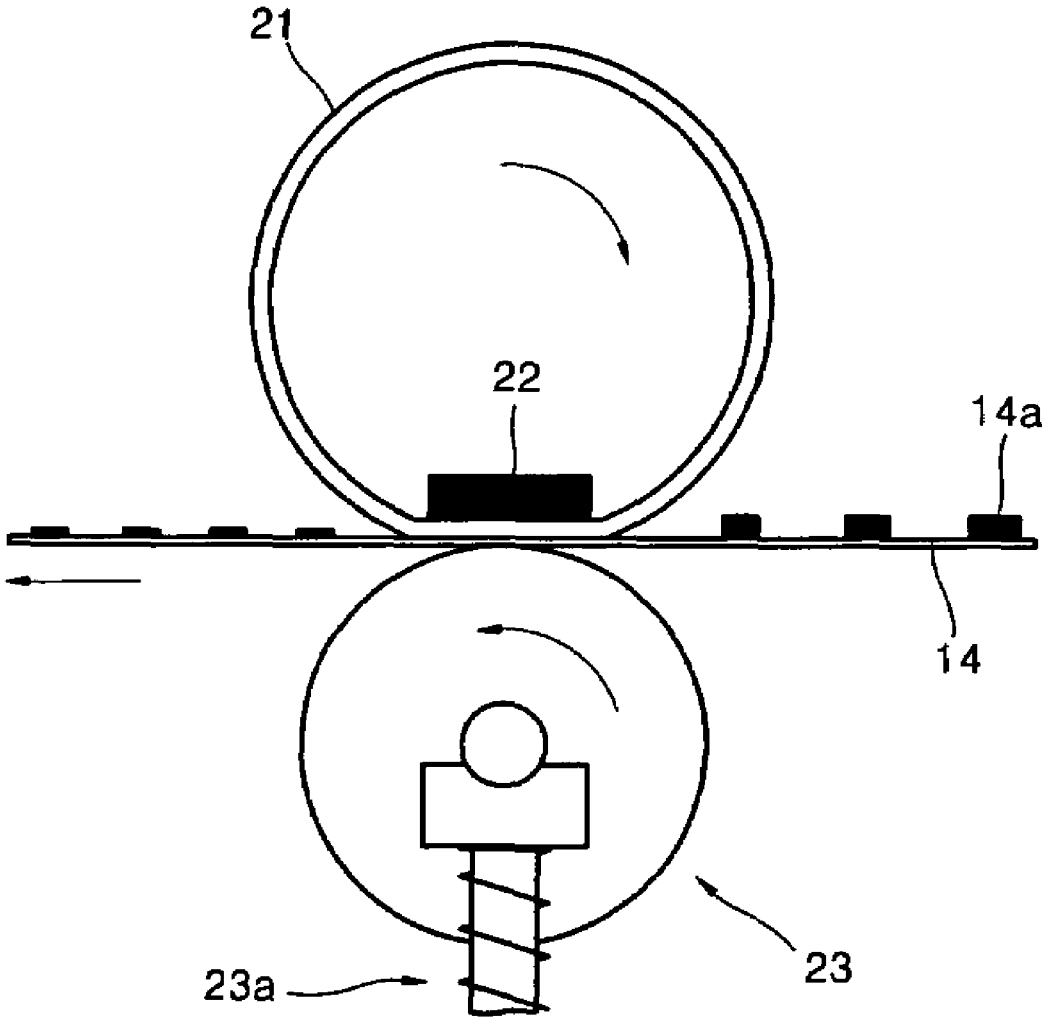
FIG. 3 (PRIOR ART)
FIG. 3 is a vertical cross-sectional view schematically illustrating another conventional fusing roller device for an electrophotographic image forming apparatus.

Hereinafter, an embodiment of the present invention will be described in detail with reference to the attached drawings, wherein like reference numerals refer to the like elements throughout. The present invention may, however, be embodied in many different forms and should not be construed as being limited to the embodiment set forth herein; rather, this embodiment is provided so that the present disclosure will be thorough and complete, and will fully convey the concept of the invention to those skilled in the art.

Figure 4:
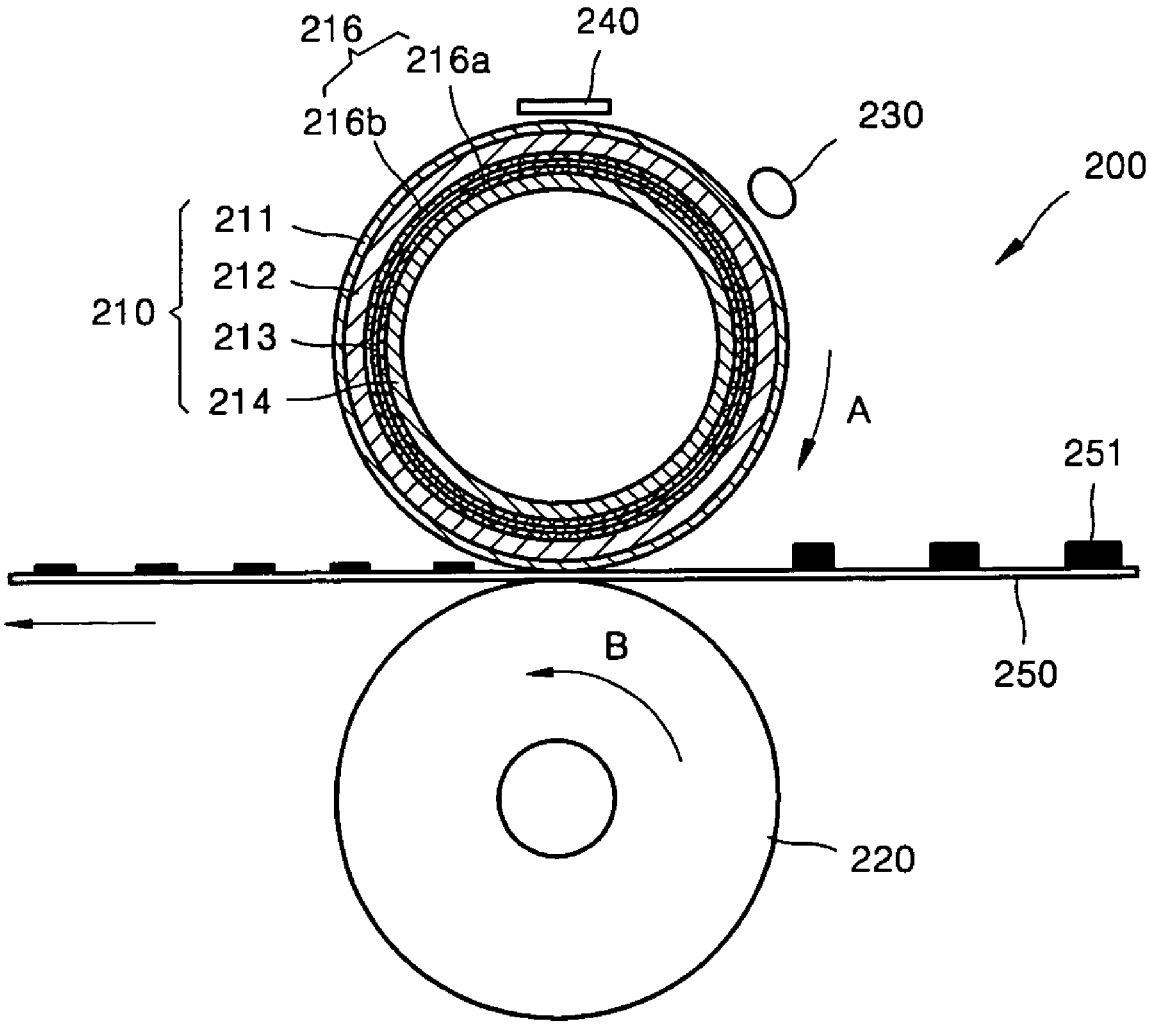
FIG. 4 is a schematic vertical cross-sectional view of a fusing portion for an electrophotographic image forming apparatus using a fusing roller device according to an embodiment of the present invention.
Figure 5:
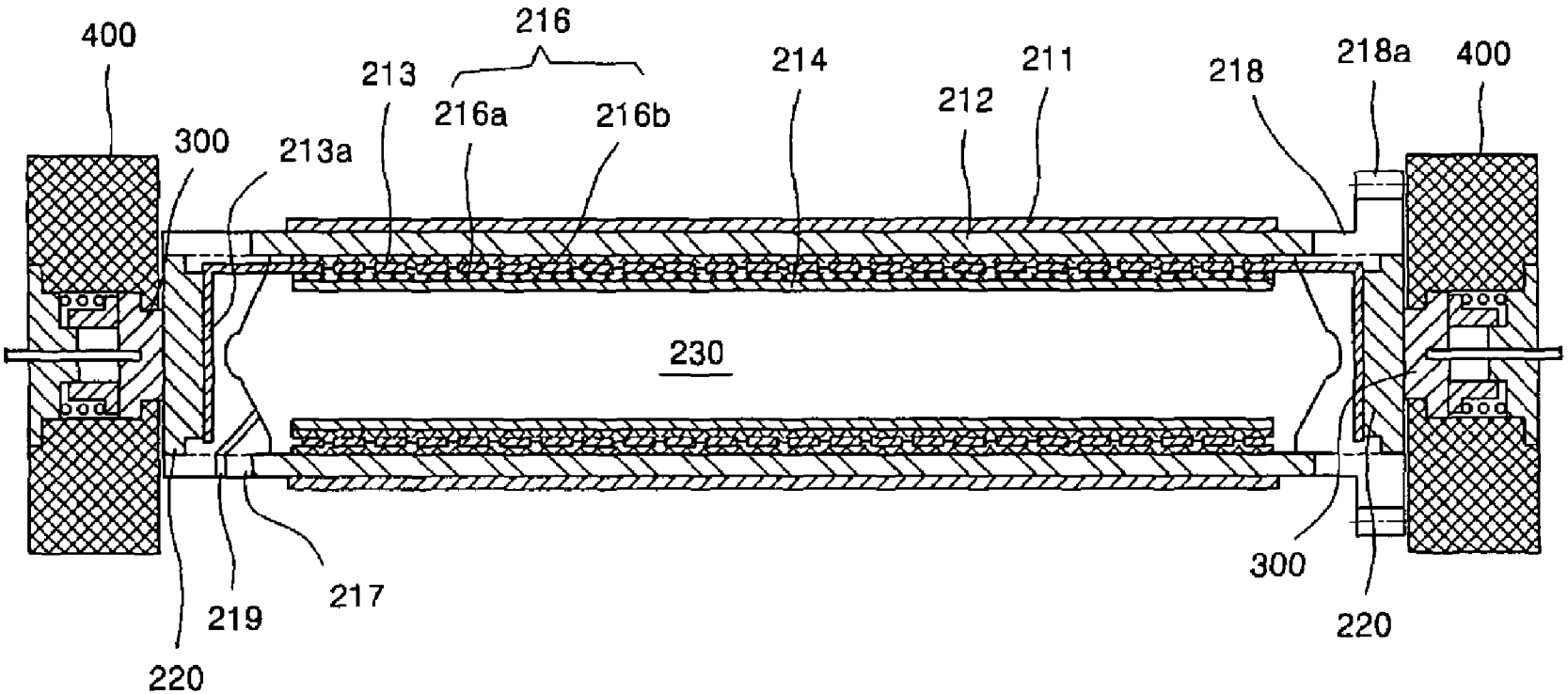
FIG. 5 is a profile cross-sectional view illustrating the structure of the fusing roller device shown in FIG. 4 when the fusing roller device is connected to a power supply device.

Referring to FIGS. 4 and 5, a fusing portion 200 for an electrophotographic image forming apparatus using a fusing roller device according to an embodiment of the present invention includes a fusing roller device 210, which rotates in a direction shown by arrow A, and a pressure roller 215 installed opposite to the fusing roller device 210. Paper 250 is placed between the fusing roller device 210 and the pressure roller 215, which contacts the fusing roller device 210, and rotates in a direction shown by arrow B.

The fusing roller device 210 includes a cylindrical fusing roller 212, a heating portion 213, and an internal tube 214. A protection layer 211 of TEFLON® is formed on the surface of the cylindrical fusing roller 212. The heating portion 213 fits closely to the inside of the fusing roller 212 in an axial direction. The heating portion 213 generates heat through current supplied from a power supply part 300 installed in a main frame 400 of the image forming apparatus (see FIG. 5). The internal tube 214 fits closely to the inside of the heating portion 213 in the axial direction, with both ends being open.

The internal tube 214 may be formed of stainless steel, aluminum (Al), or copper (Cu). Physical properties of Al and Cu are shown in Table 1.

TABLE 1

| Material | Heat conductivity (W/mK) | Mass (g) | Specific heat (J/kg ° C.) | Temperature difference (° C.) | Thermal energy (J) |
|---|---|---|---|---|---|
| Copper | 390 | 57 | 385 | 160 | 3521.7 |
| Al 6063 | 218 | 13 | 900 | 160 | 1812.0 |
| Ratio Cu to Al | 1.79 | 4.54 | 0.43 | 1 | 1.94 |

Referring to Table 1, heat energy=specific heat×mass×temperature difference, and temperature difference=fusing temperature−room temperature.

As shown in Table 1, because Al has a mass less than the mass of Cu and a high specific heat, the thermal energy is high with the same temperature difference. Thus, Al is more advantageous than Cu for heat transfer.

Therefore, in one instance of the present invention, the internal tube 214 is formed of Al, and a thickness of the internal tube 214 is less than about 0.5 mm.

The fusing roller 212 is heated by heat transferred from the heating portion 213 and fuses a toner image 251 in a powder state on the paper 250. The fusing roller 212 may be formed of stainless steel, Al, or Cu. Table 2 shows physical properties of some Al and Cu alloys.

TABLE 2

| Material | Tension strength (Mpa) | Heat conductivity (W/mK) | Specific heat (J/kg ° C.) | Thermal expansion coefficient (μs/° C.) |
|---|---|---|---|---|
| AL1100 | 130 | 222 | 904 | 23.8 |
| AL3003 | 130 | 193 | 893 | 23.9 |
| AL5052 | 280 | 136 | 880 | 25.7 |
| AL6061 | 320 | 180 | 896 | 25.2 |
| AL6063 | 190 | 218 | 616 | 25.6 |
| Cu | 200 | 390 | 385 | 17.5 |

As shown in Table 2, because the Al alloys have a thermal expansion coefficient between 23.8 and 25.9 μs/° C., thermal expansion and contraction for these alloys are similar.

In an aspect of the present embodiment, the fusing roller 212 is formed of a material having the same thermal expansion coefficient as that of the material of the internal tube 214, and, thus, the fusing roller 212 is formed of Al in this aspect of the present invention.

The heating portion 213 is insulated from the fusing roller 212 and the internal tube 214 by an insulator 216. The insulator 216 includes a first insulator 216*a* and a second insulator 216*b*. The first insulator 216*a* is interposed between the heating portion 213 and the internal tube 214, and the second insulator 216*b* is interposed between the heating portion 213 and the fusing roller 212. Thus, the heating portion 213 is spaced apart from the internal tube 214 by the thickness of the first insulator 216*a*, and the heating portion 213 is spaced apart from the fusing roller 212 by the thickness of the second insulator 216*b*.

The insulator 216 is formed, for instance, of a multi-layer seat-type insulator made of mica. Also, the insulator 216 may be formed of magnesium oxide (MgO) or aluminum oxide ($Al_2O_3$).

The heating portion 213 generates heat through current supplied from the power supply part 300 and contacts an inner surface of the fusing roller 212 and an outer surface of the internal tube 214. The heating portion 213 is formed of a resistant heating coil, for instance.

An end cap 217 and a power transmission end cap 218 are installed on both ends of the fusing roller device 210. The power transmission end cap 218 has a structure similar to that of the end cap 217, and includes a power transmission device 218*a*, which is connected to a motor (not shown) installed in the frame 400 to support and rotate the fusing roller device 210. The power transmission device 218*a* is a toothed structure, for instance, formed on a circumference of the power transmission end cap 218 that engages the motor.

An air vent 219 is formed in the end cap 217. The air vent 219 ventilates an internal space 230 of the fusing roller device 210, after the end cap 217 is installed in the fusing roller device 210, such that the pressure of the internal space 230 of the fusing roller device 210 is maintained at atmospheric pressure. Thus, even though the internal tube 214 is heated by heat transferred from the heating portion 213, the internal space 230 of the fusing roller device 210 is ventilated through the air vent 219, and, thus, the atmospheric pressure is maintained. The air vent 219 may be provided in the power transmission end cap 218. Also, the air vent 219 may be provided in both the end cap 217 and the power transmission end cap 218.

An electrode 220 is installed in the end cap 217 and the power transmission end cap 218, respectively. The electrode 220 is electrically connected to a lead part 213*a* that extends from both ends of the heating portion 213. Current supplied from an external power source is supplied to the heating portion 213 via the power supply part 300, the electrode 220, and the lead part 213*a*.

A method of manufacturing the fusing roller device 210 is described below.

The first insulator 216*a* is installed around the circumference of the internal tube 214. The heating portion 213 is installed around the first insulator 216*a*. Next, the second insulator 216*b* is installed around the heating portion 213.

The internal tube 214, upon which the heating portion 213, the first insulator 216*a*, and the second insulator 216*b* are provided as described above, is inserted in the fusing roller 212. The surface of the fusing roller 212 is coated with TEFLON®.

Next, using a device for extending the internal tube 214, both ends of the internal tube 214 are closed, a predetermined pressure is applied to an internal space 230 formed inside the internal tube 214, and the internal tube 214 is extended. In one instance, the pressure applied is over about 140 millibars.

When the internal tube 214 is extended, the fusing roller 212 is maintained in a circular shape, and the heating portion 213 and the insulator 216 are plastically deformed. Thus, the heating portion 213, the internal tube 214, the first insulator 216*a*, and the second insulator 216*b* are closely adhered to one another, and the heating portion 213 is closely adhered to the inner surface of the fusing roller 212. That is, because the heating portion 213 is formed of a resistant heating coil, when the internal tube 214 is extended, a space between adjacent coils is filled with the first insulator 216*a* and the second insulator 216*b*, and the heating portion 213 is completely and closely adhered to the internal tube 214.

However, if the pressure is less than about 140 millibars when the internal tube 214 is extended, the space between adjacent coils of the heating portion 213 is not completely filled with the first insulator 216*a* and the second insulator 216*b*. Thus, an air gap is formed in the space between adjacent coils of the heating portion 213. Also, because there is a portion in which the fusing roller 212, the heating portion 213, and the internal tube 214 contact one another and because these elements are not completely and closely adhered to one another, the air gap may be formed in the space between adjacent coils of the heating portion 213. Due to the air gap, heat transfer efficiency from the heating portion 213 to the fusing roller 212 is lowered, and, thus, the FPOT increases.

The operation of the fusing roller device 210 for the electrophotographic image forming apparatus having the above structure, according to the present invention, is described below with reference to the accompanying drawings.

Referring to FIG. 5, current supplied from an external power source (not shown) is transferred to the heating portion 213 via the power supply part 300, the electrode 220, and the lead part 213*a*. As a result, the heating portion 213 generates resistant heat that is transferred to the fusing roller 212 and the internal tube 214. Accordingly, the temperature of the fusing roller 212 increases by the heat transferred from the heating portion 213 and reaches a fusing temperature.

Figure 6:
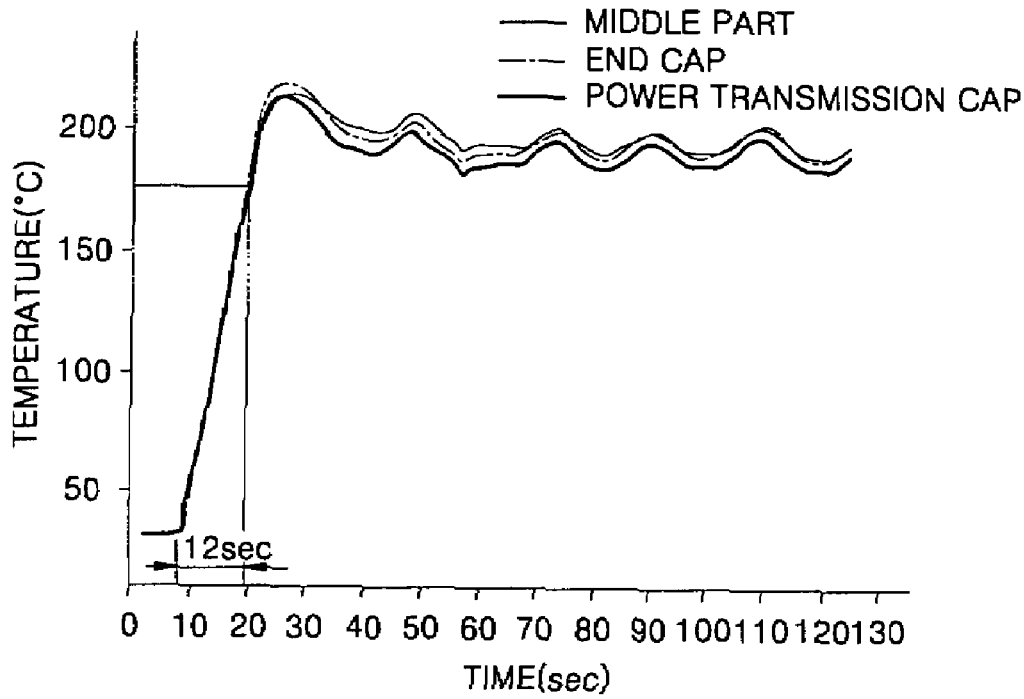
FIG. 6 is a graph of temperature versus time illustrating a first experimental example in which the temperature of the fusing roller device is increased to a fusing temperature from room temperature by supplying current to the fusing roller device under predetermined conditions.

FIG. 6 is a graph of temperature versus time illustrating a first experimental example in which the temperature of the fusing roller device 210 is increased to the fusing temperature from room temperature by supplying current to the fusing roller device 210 under predetermined conditions. Temperature variation in the graph of FIG. 6 is determined for a middle part and both ends (i.e., the end cap, 217 and the power transmission end cap 218) of the fusing roller device 210. Referring to FIG. 6, the horizontal axis represents time and the vertical axis represents temperature. When current was supplied to the heating portion 213 having an electrical resistance of 36.73 Ω and a heating capacity of 1168 watts, the fusing roller device 210 took 12 seconds to heat from room temperature to a fusing temperature of 180° C. In this experiment, the maximum current was 9.2 A (5.74 A rms).

Because a conventional fusing roller device using a heat pipe in which a functional fluid is held under the same conditions as above takes about 17 seconds to heat from room temperature to the fusing temperature, the fusing roller device 210 according to the first experimental example of the present invention takes about 5 seconds less than the fusing roller device using a heat pipe in which a functional fluid is held to heat from room temperature to the fusing temperature. Thus, the fusing roller device 210 according to the present invention can reduce the FPOT compared with the fusing roller device using a heat pipe in which a functional fluid is held.

Figure 7:
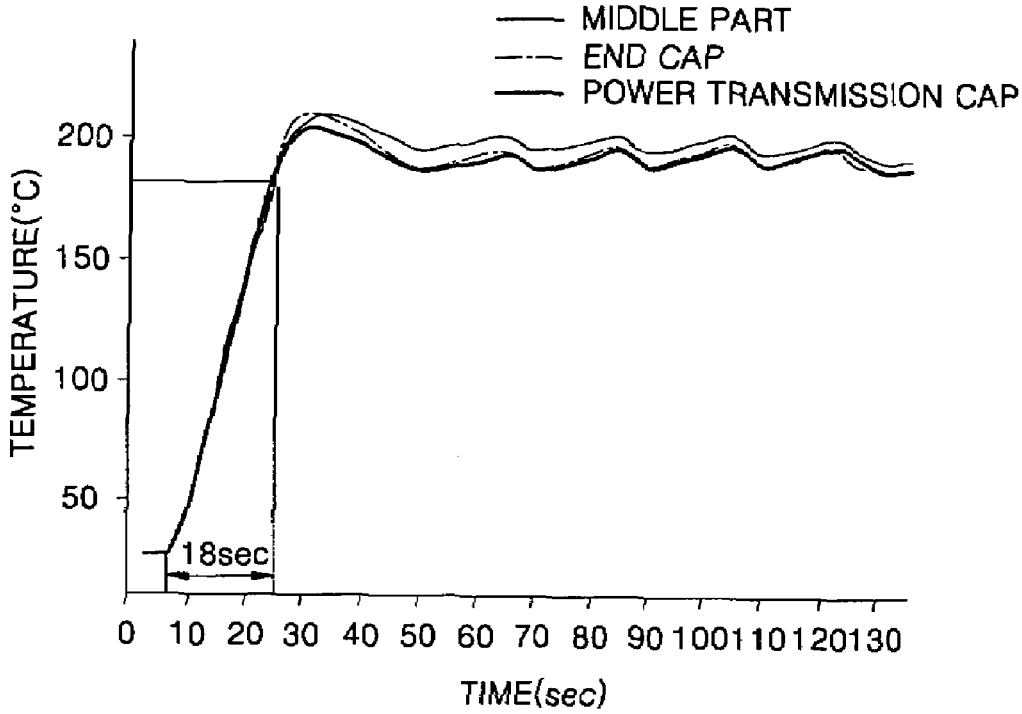
FIG. 7 is a graph of temperature versus time illustrating a second experimental example in which the temperature of the fusing roller device is increased to a fusing temperature from room temperature by supplying current to the fusing roller device under other conditions other than those used in the first experimental example of FIG. 6.

FIG. 7 is a graph of temperature versus time illustrating a second experimental example in which the temperature of the fusing roller device 210 is increased to the fusing temperature from room temperature by supplying current to the fusing roller device 210 under different conditions.

Referring to FIG. 7, when current was supplied to the heating portion 213 having an electrical resistance of 55.8 Ω and a heating capacity of 863 watts, the fusing roller device 210 took 18 seconds to heat from room temperature to the fusing temperature of 180° C. In this example, the maximum current was 6.7 A (4 A rms).

Comparing the second experimental example with the first experimental example, in the second experimental example, the capacity of the heating portion 213 was reduced by about 300 watts compared to the first experimental example, and the current value was reduced by about 1.74 A rms.

In general, in the second experimental example, because the fusing roller device 210 took 18 seconds to heat from room temperature to the fusing temperature under the conditions of the second experimental example, compared to about 17 seconds for the device using a heat pipe under the conditions of the first experimental example, the fusing roller device 210 according to the present invention can use a heating portion 213 with a capacity reduced by about 300 watts and a current value reduced by about 1.74 A rms and achieve results similar to those of the fusing roller device using a heat pipe. Thus, the present invention is advantageous in that it requires lower current and power.

As described above, the fusing roller device 210 for the electrophotographic image forming apparatus according to the present invention has the following advantages. First, by using the aluminum internal tube 214, heat transfer efficiency increases such that the surface temperature of the fusing roller 212 increases from room temperature to the fusing temperature in less time. Second, by reducing the capacity of the heating portion 213, the fusing roller device 210 requires lower current and power. Third, by using the aluminum internal tube 214, the overall weight of the fusing roller device 210 is reduced and rotation inertia is lowered, such that a torque applied to the power transmission end cap 218 can be reduced. Fourth, because the process for manufacturing the aluminum internal tube 214 is simple, costs of the fusing roller device 210 can be reduced. Fifth, by forming the fusing roller 212 and the internal tube 214 of the same material, a mica insulating seat (not shown) can be prevented from being displaced due to a difference in the thermal expansion coefficients of the roller 212 and the tube 214.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A fusing roller device for an electrophotographic image forming apparatus, the device comprising:

an internal tube having both ends open;

a heating portion surrounding the internal tube and generating heat by externally supplied current; and a fusing roller, surrounding the heating portion, comprising a cylindrical body and a protective layer to fuse a toner image on paper by heat transferred from the heating portion, wherein the heating portion is pressure adhered with the internal tube adhering a surface of the internal tube and insulating portions of the heating portion through application of a predetermined pressure.

2. The device of claim 1, wherein the internal tube is formed of aluminum (Al).

3. The device of claim 2, wherein the internal tube and the fusing roller are formed of aluminum (Al) having similar thermal expansion coefficients.

4. The device of claim 1, wherein the fusing roller is formed of aluminum (Al).

5. The device of claim 1, wherein the heating portion is formed of a resistant heating coil.

6. The fusing roller device of claim 1, further comprising:

an end cap and a power transmission end cap respectively installed on ends of the fusing roller; and an air vent provided in one of the end cap or the power transmission end cap to ventilate an internal space of the fusing roller, with an internal pressure in the fusing roller being maintained at an atmospheric pressure.

7. The device of claim 6, further comprising:

a power supply part receiving current from an external power source;

a lead part extending from both ends of the heating portion; and electrodes respectively provided in the end cap and in the power transmission end cap, wherein current is supplied from the external power source to the heating portion through the power supply part, the electrodes, and the lead part, the heating portion contacting an inner surface of the fusing roller and an outer surface of the internal tube to increase the temperature of the fusing roller to a fusing temperature.

8. The device of claim 1, further comprising an insulator made of mica to insulate the heating portion from the internal tube and the fusing roller.

9. The device of claim 8, wherein the insulator comprises:

a first insulator interposed between the heating portion and the internal tube; and a second insulator interposed between the heating portion and the fusing roller.

10. The device of claim 1, further comprising an insulator made of magnesium oxide (MgO) to insulate the heating portion from the internal tube and the fusing roller.

11. The device of claim 1, further comprising an insulator made of aluminum oxide ($Al_2O_3$) to insulate the heating portion from the internal tube and the fusing roller.

12. A fusing roller device for an electrophotographic image forming apparatus, the device comprising:

an internal tube having both ends open;

a heating portion surrounding the internal tube and generating heat by externally supplied current; and a fusing roller, surrounding the heating portion, comprising a cylindrical body and a protective layer to fuse a toner image on paper by heat transferred from the heating portion, wherein the thickness of the internal tube is less than about 0.5 mm.

13. A fusing roller device for an electrophotographic image forming apparatus, the device comprising:

an internal tube having both ends open;

a heating portion surrounding the internal tube and generating heat by externally supplied current;

a fusing roller, surrounding the heating portion, comprising a cylindrical body and a protective layer to fuse a toner image on paper by heat transferred from the heating portion;

an end cap and a power transmission end cap respectively installed on ends of the fusing roller; and an air vent provided in one of the end cap or the power transmission end cap to ventilate an internal space of the fusing roller, with an internal pressure in the fusing roller being maintained at an atmospheric pressure.

14. The device of claim 13, further comprising:

a power supply part receiving current from an external power source;

a lead part extending from both ends of the heating portion; and electrodes respectively provided in the end cap and in the power transmission end cap, wherein current is supplied from the external power source to the heating portion through the power supply part, the electrodes, and the lead part, the heating portion contacting an inner surface of the fusing roller and an outer surface of the internal tube to increase the temperature of the fusing roller to a fusing temperature.

15. A fusing roller device for an electrophotographic image forming apparatus, the device comprising:

an internal tube having both ends open;

a heating portion surrounding the internal tube and generating heat by externally supplied current;

a fusing roller, surrounding the heating portion, comprising a cylindrical body and a protective layer to fuse a toner image on paper by heat transferred from the heating portion; and an insulator made of mica to insulate the heating portion from the internal tube and the fusing roller.

16. The device of claim 15, wherein the insulator comprises:

a first insulator interposed between the heating portion and the internal tube; and a second insulator interposed between the heating portion and the fusing roller.

17. The device of claim 15, wherein the heating portion, the insulator, the internal tube, and the fusing roller are pressed by a predetermined pressure and closely adhered to one another.

18. A fusing roller device for an electrophotographic image forming apparatus, the device comprising:

an internal tube having both ends open;

a heating portion surrounding the internal tube and generating heat by externally supplied current;

a fusing roller, surrounding the heating portion, comprising a cylindrical body and a protective layer to fuse a toner image on paper by heat transferred from the heating portion; and an insulator made of magnesium oxide (MgO) to insulate the heating portion from the internal tube and the fusing roller.

19. The device of claim 18, wherein the heating portion, the insulator, the internal tube, and the fusing roller are pressed by a predetermined pressure and closely adhered to one another.

20. A fusing roller device for an electrophotographic image forming apparatus, the device comprising:

an internal tube having both ends open;

a heating portion surrounding the internal tube and generating heat by externally supplied current;

a fusing roller, surrounding the heating portion, comprising a cylindrical body and a protective layer to fuse a toner image on paper by heat transferred from the heating portion; and an insulator made of aluminum oxide ($Al_2O_3$) to insulate the heating portion from the internal tube and the fusing roller.

21. The device of claim 20, wherein the heating portion, the insulator, the internal tube, and the fusing roller are pressed by a predetermined pressure and closely adhered to one another.

22. A fusing roller device for an electrophotographic image forming apparatus, the device comprising:

an internal tube having both ends open;

a heating coil surrounding the internal tube and generating heat by externally supplied current; and a fusing roller, surrounding the heating coil, to fuse a toner image on paper by heat transferred from the heating coil, wherein the heating coil is pressure adhered with the internal tube adhering a surface of the internal tube and insulating portions of the heating portion through application of a predetermined pressure.

23. A fusing roller device for an electrophotographic image forming apparatus, the device comprising:

an internal tube made of aluminum having both ends open;

a heating portion surrounding the internal tube and generating heat by externally supplied current; and a fusing roller, surrounding the heating portion, comprising a cylindrical body and a protective layer to fuse a toner image on paper by heat transferred from the heating portion, the aluminum internal tube increasing a heat transfer efficiency, wherein the heating portion is pressure adhered with the internal tube adhering a surface of the internal tube and insulating portions of the heating portion through application of a predetermined pressure.

* * * * *